United States Patent [19]

Wagener et al.

[11] 4,407,701

[45] Oct. 4, 1983

[54] APPARATUS FOR TREATING GASES PRODUCED FROM COAL

[75] Inventors: Dietrich Wagener; Horst Fach; Peter Sauder, all of Essen; Otto Abel, Clausthal-Zellerfeld, all of Fed. Rep. of Germany

[73] Assignee: Didier Engineering GmbH, Fed. Rep. of Germany

[21] Appl. No.: 404,534

[22] Filed: Aug. 2, 1982

Related U.S. Application Data

[60] Continuation of Ser. No. 205,931, Nov. 12, 1980, abandoned, which is a continuation-in-part of Ser. No. 169,672, Jul. 17, 1980, abandoned, which is a division of Ser. No. 69,866, Aug. 27, 1979, abandoned.

[30] Foreign Application Priority Data

Aug. 28, 1978 [DE] Fed. Rep. of Germany ..... 2837416

[51] Int. Cl.[3] ..... C10B 27/00

[52] U.S. Cl. ..... 202/99; 48/77; 202/215; 202/255; 202/270

[58] Field of Search ..... 48/61, 77, 203; 202/85, 202/86, 87, 99, 215, 270, 255

[56] References Cited

U.S. PATENT DOCUMENTS

| | | | |
|---|---|---|---|
| 1,273,474 | 7/1918 | Fleischer | 48/203 |
| 1,553,795 | 9/1925 | Alidjiadis | 202/85 |
| 1,873,078 | 8/1932 | Ackeren | 202/255 |
| 2,591,595 | 4/1952 | Ogorzaly | 48/203 |
| 2,805,188 | 9/1907 | Josenhans | 201/9 |
| 4,028,068 | 6/1977 | Kiener | 48/203 |

*Primary Examiner*—Peter F. Kratz

*Attorney, Agent, or Firm*—Wood, Herron & Evans

[57] ABSTRACT

Apparatus for treating gases produced from the conversion of coal, e.g., from carbonization of coal, to remove the undesirable constituents thereof is disclosed. The method involves passing the hot raw gases from the coal conversation process over a coke bed at a temperature of more than 1100° K. The coke bed is located in the coal gasification reactor and is provided with an ordinary air supply. The subject method achieves a significant reduction in undesirable constituents in the gas and eliminates the need for auxiliary gas treatment systems, oxygen production systems and the like.

2 Claims, 1 Drawing Figure

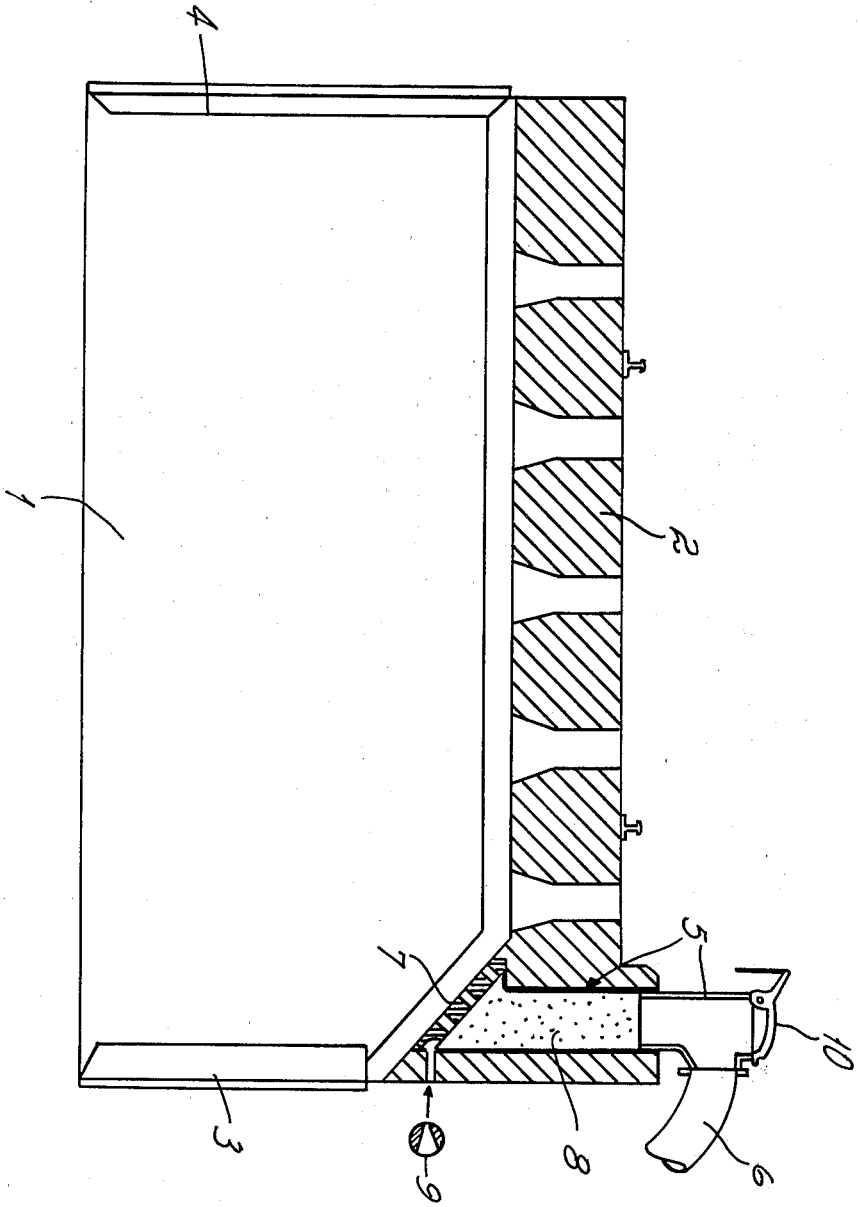
10
6
5
8
9
7
2
1
3
4

APPARATUS FOR TREATING GASES PRODUCED FROM COAL

CROSS-REFERENCE TO RELATED APPLICATIONS

This application is a continuation of application Ser. No. 205,931, filed on Nov. 12, 1980, now abandoned, which is a continuation-in-part of application Ser. No. 169,672, filed on July 17, 1980, now abandoned, which was a division of application Ser. No. 069,866, filed on Aug. 27, 1979, now abandoned.

BACKGROUND OF THE INVENTION

This invention relates to the treatment of gases produced in coal conversion processes, such as coke-oven gases.

Coke-oven gases produced, for example, from the operation of a battery of coke ovens contain, in addition to the major constituents of $H_2$, $CH_4$, CO and $CO_2$, a number of other substances such as unsaturated hydrocarbons, $NH_3$, HCN, benzene and other aromatic hydrocarbons, as well as tar, $H_2S$, and organic sulphur compounds. To use these gases further, it is necessary to remove a substantial amount of these accompanying substances. To this end, hot coke-oven gases have heretofore been cooled in a subsequent condensation stage. Using an auxiliary reclamation process, napthalene, $NH_3$, benzene, tar and sulphur have been separated and reclaimed, for example. The market value of such by-products, however, is low; and, therefore, the by-products cannot be reclaimed economically. Nevertheless, because of the undesirable nature of these substances in the raw gas, they must be removed before the gases can be released to the environment. Frequently, the purification process itself generates environmentally harmful waste water and gases, which must be eliminated at great expense.

In an attempt to avoid these disadvantages, it has been suggested that the raw gases from the coke-oven while still hot, i.e., without cooling and purification, be subjected to partial oxidation with the aid of oxygen, oxygen-enriched air, or other oxygenic gas mixtures to thereby convert the undesirable constituents thereof to a carbon monoxide and hydrogen-rich separated gas stream. However, these processes require considerable amounts of oxygen and thus require an oxygen supply at additional capital investment or at considerable cost.

BRIEF DESCRIPTION OF THE INVENTION

Accordingly, it has been among the objects of this invention to provide an apparatus for treating gases produced by the conversion of coal to remove the undesirable constituents in the hot raw gases in a simple, dependable and economic fashion without the customary reclamation or oxygen treatment systems.

The present invention is predicated on the discovery that a substantial portion of these undesirable constituents of the gas stream may be removed by passing the hot raw gas from the coal conversion process over a coke bed at a temperature of more than 1100° K. Preferably, the temperature is about 1250° K. Depending on the processing conditions selected, the aforementioned substances found in the raw gases are either completely or at least partially decomposed. The $H_2S$ still present in the gas stream may be removed through the use of scrubbing systems well known in coking or refining technology. By passing the raw gas through the hot coke bed while still hot, it is possible to utilize not only the heat content of the gas in further processing, but also to avoid condensation of substances present in the gas stream. These substances are decomposed in the hot coke bed thereby preventing their emission to the atmosphere which would otherwise be environmentally harmful.

In accordance with the present invention, the retention time of the raw gas in the hot coke bed may be varied within broad limits depending on the composition of the gas and the temperature of the hot coke bed. However, in general, about 50 to 300 $Nm^3$ of raw gas is passed over the bed per cubic meter of coke bed.

The apparatus of the present invention admits of several different arrangements of the coke bed. In a preferred form of the invention, however, the coke bed is provided within the coal gasifier itself so that undesirable condensation of tar can be avoided. If the coke is provided in a reactor separate from the gasifier, the raw gas is preferably passed to the coke bed through a pipe which is as short as possible and well heated to prevent undue condensation.

However, a reactor including the coke bed is the preferred form of the invention and further includes suitable means for charging the coke to the reactor and for discharging the ash and/or the coke. The reactor may be charged with either hot or cold coke. Any required heating of the coke bed within the reactor may be done either directly or indirectly by appropriate design of the heating walls and/or regulation of the air supply to the coke bed.

BRIEF DESCRIPTION OF THE DRAWINGS

FIG. 1 is a longitudinal cross-sectional view of an apparatus for carrying out the invention.

DETAILED DESCRIPTION OF THE INVENTION

The production of usable gases from the raw gas stream produced by the conversion of coal in a surprisingly simple and safe fashion according to the principles of the present invention was confirmed by the following tests.

Raw gas was produced from coking coal in an electrically heated furnace and subsequently passed through a reaction zone consisting of a bed of coke also located in an electric furnace. The temperature of the reaction zone and the retention time of the raw gas in the reaction zone was varied. The composition of the gas stream before and after treatment in accordance with the method of this invention was analyzed. The raw gas produced from the coking coal had the following composition (without air).

| | Volume/% |
|---|---|
| $H_2$ | 55.1 |
| CO | 6.3 |
| $CH_4$ | 35.6 |
| $CO_2$ | 1.7 |
| $C_2^+$ | 0.2 |
| $C_2^-$ | 1.1 |
| | $g/Nm^3$ |
| $H_2S$ | 4.64 |
| $NH_3$ | 3.23 |
| $C_6H_6$ | 44.00 |
| HCN | 6.8 |
| Condensate | Water and tar (brownish-black) |

-continued

| | |
|---|---|
| | about 90 g/Nm$^3$ |

EXAMPLE I

The raw gas at a temperature of about 1250° K. and a spatial velocity of 65 Nm$^3$/m$^3$ was passed over a coke bed. The gas discharged from the reactor having the coke bed had the following composition.

| | Volume/% |
|---|---|
| $H_2$ | 63.8 |
| CO | 17.2 |
| $CH_4$ | 16.9 |
| $CO_2$ | 2.1 |
| $C_2^+$ | 0.0 |
| $C_2^-$ | 0.0 |
| | g/Nm$^3$ |
| $H_2S$ | 3.44 |
| $NH_3$ | 0.02 |
| $C_6H_6$ | 8.6 |
| HCN | 0.05 |
| Condensate | Water, no tar determinable |

EXAMPLE II

The raw gas was passed over the coke bed at 1100° K. and a spatial velocity of 40 Nm$^3$/m$^3$. The gas discharged from the reactor having the coke bed had the following composition.

| | Volume/% |
|---|---|
| $H_2$ | 57.5 |
| CO | 7.4 |
| $CH_4$ | 30.9 |
| $CO_2$ | 2.9 |
| $C_2^+$ | 0.3 |
| $C_2^-$ | 1.0 |
| | g/Nm$^3$ |
| $H_2S$ | 4.44 |
| $NH_3$ | 1.30 |
| $C_6H_6$ | 36.0 |
| Condensate | Water and yellow tar product (napthalene) about 30 g/Nm$^3$ |

These test results clearly demonstrate the substantial reduction of the undesirable substances found in the raw gas stream and the substantial improvement of the gas quality achieved thereby.

Referring now to the attached FIG. 1, suitable apparatus for carrying out the invention is illustrated. A coke oven 1 is provided with two entrance doors 3 and 4. The dimensions of these doors are different due to the asymmetric shape of the roof 2 of the coke oven. A vertical standpipe 5 is positioned above the entrance door 3 and runs through a reinforced section of the roof 2. This standpipe is connected to another pipe section which extends above the roof of the oven and which is open at its top and on one side. This pipe section is in turn connected to a gas collector (not shown) by means of an elbow 6. The gas inlet of the standpipe 5, which is located in the roof 2 of the oven, is provided with an inclined grate 7 which serves as a support for a coke bed 8. A system of air ducts 9 is provided to feed a controlled supply of air into the coke bed 8. This air supply may be branched off from the main heating system of the coke oven. The surface of the inclined grate 7 should be as large as possible so as to provide a wide entrance area for the gases. The standpipe 5 which is located above the inclined grate 7 acts as a reactor and is enclosed within the reinforced roof 2 of the oven and is heated by the usual heating system of the coke oven. The standpipe 5 is provided at its upper end with a pivotal valve 10. When this valve is opened, a charge of hot coke may be fed into the reactor. This coke is quickly brought up to a temperature of 1250° K. by the heat generated in the walls of the oven and by the high temperatures that exist inside the oven. The air fed through the ducts 9 causes the coke bed to glow.

As a result of the apparatus described above, the raw gases from the conversion of the coke are caused to pass through the bed of glowing coke and are then discharged into the collector free of emissions that may be harmful to the environment.

Thus having described the invention, we claim:

1. Coal conversion apparatus for the production of coke and the treatment of gases produced by the conversion of coal to coke in said apparatus to reduce the level of undesirable constituents in said gases comprising a coke oven for receiving coal for conversion to coke and gases, said coke oven having a roof, a vertically ascending standpipe mounted in said roof containing a coke bed at a temperature of at least about 1100° K., grate means at the bottom of said standpipe for supporting said coke bed from below in said standpipe while permitting said gases to pass upwardly through said standpipe without substantial condensation of said gases such that said gases pass through said coke bed in said standpipe to be treated thereby, and duct means communicating with said standpipe at its lower end for introducing a controlled amount of air into said coke bed in said standpipe.

2. The apparatus of claim 1 wherein the dimensions of said standpipe are sufficient to support a coke bed of a volume sufficient to treat said gases at a spatial velocity of about 50 to 300 Nm$^3$ per cubic meter of coke bed.

* * * * *